US006522057B1

(12) United States Patent
Lee

(10) Patent No.: US 6,522,057 B1
(45) Date of Patent: Feb. 18, 2003

(54) ELECTRON GUN FOR CATHODE RAY TUBE

(75) Inventor: Sang-hoon Lee, Pusan (KR)

(73) Assignee: Samsung SDI Co., Ltd., Kyungki-Do (KR)

( * ) Notice: Subject to any disclaimer, the term of this patent is extended or adjusted under 35 U.S.C. 154(b) by 0 days.

(21) Appl. No.: 09/547,094

(22) Filed: Apr. 11, 2000

(30) Foreign Application Priority Data

Oct. 4, 1999 (KR) ..... 99-42584

(51) Int. Cl.[7] ..... H01J 29/58

(52) U.S. Cl. ..... 313/414; 313/449; 315/382.1; 315/14; 315/382

(58) Field of Search ..... 313/414, 449; 315/382.1, 382, 14, 15

(56) References Cited

U.S. PATENT DOCUMENTS 5,600,201 A 2/1997 Yun et al.

5,760,550 A * 6/1998 Sukeno et al. ..... 315/382.1

FOREIGN PATENT DOCUMENTS

KR 1992-0000759 1/1992

* cited by examiner

*Primary Examiner*—Vip Patel
*Assistant Examiner*—Ken A Berck
(74) *Attorney, Agent, or Firm*—Lowe Hauptman Gilman & Berner, LLP

(57) ABSTRACT

The screen electrode in an electron gun for use in a cathode ray tube has multi-stage apertures such that the entrance area of an aperture is larger than the exit area. This has an effect of smaller screen electrode apertures with a result of increased pre-focusing of electron beams passing through the apertures. Thus, increased pre-focusing reduces the beam incident angle to the main lens. A smaller beam incident angle generates less spherical aberration in the main lens.

6 Claims, 4 Drawing Sheets

ELECTRON GUN FOR CATHODE RAY TUBE

BACKGROUND OF THE INVENTION

1. Field of the Invention

The present invention relates to an electron gun in a cathode ray tube and more particularly to a triode portion of an electron gun that allows adjustment of a beam cross-over point and improves cut-off level.

2. Description of the Related Art

A cathode ray tube displays an image by scanning electron beams emitted from an electron gun to the phosphor-coated screen of an evacuated tube. Conventionally, an electron gun is comprised of a triode, a plurality of focus electrodes and a final accelerating electrode, arranged in sequence. The plurality of focus electrodes form a pre-focus electron lens while the final accelerating electrode along with its adjacent focus electrode form a main lens. In an in-line aperture electron gun, the electron beam spot becomes undesirably large and distorted due to a non-uniform deflection field generated by a deflection yoke, which makes the focused electron beams deflected to scan the screen. In order to prevent such distortion of electron beam spots, a dynamic focus quadrupole lens electron gun is commonly used, which distorts the beam spots in such a manner that the distortion due to the deflection yoke is canceled and changes a focus voltage when the periphery of the screen is scanned. Referring to FIG. 1, a conventional triode consists of three cathodes 11, a control electrode 12 and a screen electrode 13. On the control electrode 12 and screen electrode 13 are formed three in line electron-beam passing holes 14 and 15 corresponding to the three cathodes 11. The apertures 14 in the control electrode 12 are vertically elongated slots while the apertures 15 in the screen electrode 13 are horizontally elongated slots. Electrons emitted from the cathodes 11 are pre-focused as they pass through the apertures in the control and screen electrodes 12 and 13. The thicknesses of the electrodes 12 and 13 and the shapes of the apertures 14,15 affect the beam incident angle to the main lens. As the control electrode 12 is made thinner, the size of the beam spots becomes smaller, which results in a smaller beam incident to the main lens so that the spherical aberration is reduced. A thicker screen electrode 13 also reduces a beam incident angle to the main lens so that the electron beams are focused more intensely. The sizes and shapes of apertures 14, 15 of the electrodes 12 and 13 are also a factor in the determination of the electron beams focusing. If apertures 14 in the control electrode 12 are large with all the other things being equal, more beam current can flow so that the beam spots become larger. On the other hand, if the apertures 14 are small, the current density must increase in order to maintain a same brightness level. In the other words, a larger quantity of electrons should be produced. In this case, the cathodes 11 do not last long. When the apertures 15 in the screen electrode 13 are smaller, the pre-focusing gets stronger and accordingly the incident angle to the main lens becomes smaller. Therefore, the electron beams experience less spherical aberration. However, the beam spots become larger because the beams are under the influence of a weaker main focusing. The sizes of the screen electrode apertures 15 are related to the cut-off. Large apertures 15 allow an electric field to penetrate into the first focus lens' electric field. This has an effect of increased electric field on the surfaces of the cathodes 11 but that of the screen electrode 13 decreases. Thus, the influence of the aperture size on the cut-off voltage is not that serious. If the distance between the control electrode 12 and screen electrode 13 is large, the lens becomes stronger and incidence angle in the cross over becomes smaller. On the other hand, if the distance between the control electrode and the screen electrode 12 and 13 is small, a defocusing phenomenon of electron beams deflected on the periphery of the screen can be reduced. However, the beam spot size in a center area of the screen increases such that the resolution becomes poor.

SUMMARY OF THE INVENTION

It is an objective of the present invention to provide a screen electrode having electron beam passing apertures that allows the adjustment of a cross-over point and improves the cut-off level characteristics ultimately for reduced spherical aberration. In order to achieve the objective, the screen electrode of an electron gun for use in a cathode ray tube has multi-stage apertures such that the entrance area of an aperture is larger than the exit area thereof. This has an effect of smaller screen electrode apertures with a result of increased pre-focusing of electron beams passing through the apertures. Thus, increased pre-focusing reduces the beam incident angle to the main lens. A smaller beam incident angle generates less spherical aberration in the main lens.

DESCRIPTION OF THE PREFERRED EMBODIMENTS

Figure 1:
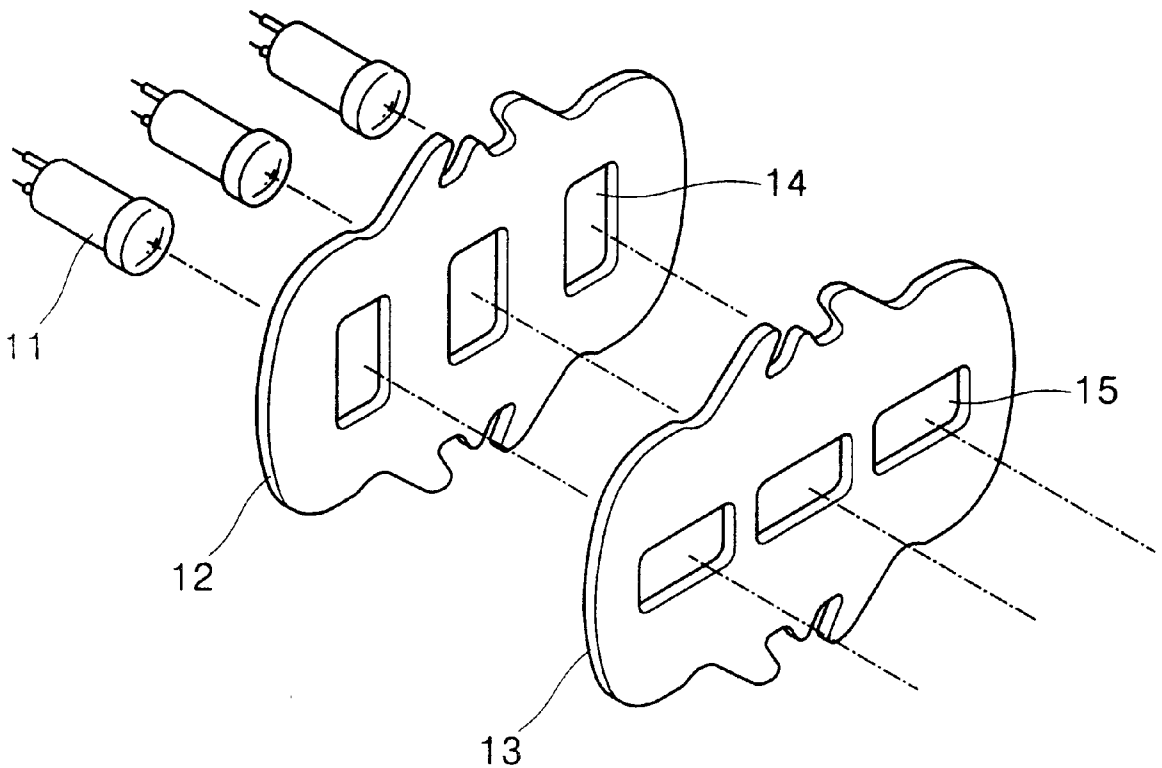
FIG. 1 (PRIOR ART)
FIG.1 is an exploded view of a conventional triode.
Figure 2:
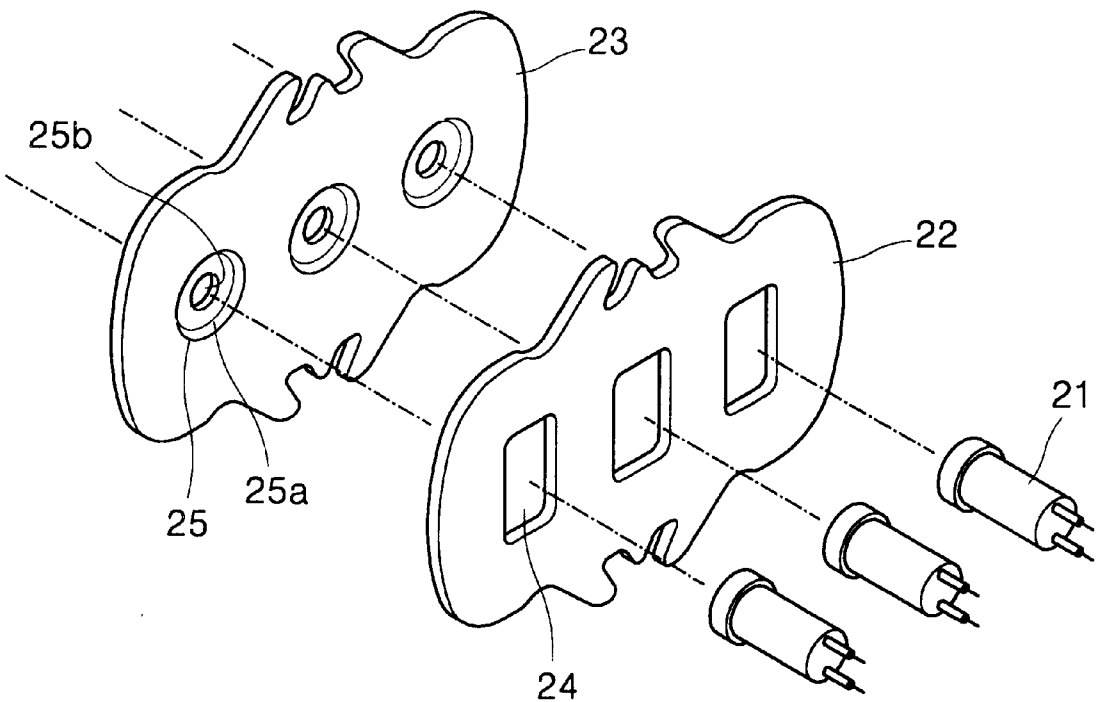
FIG.2 is an exploded view of a first triode embodiment of the present invention.
Figure 3:
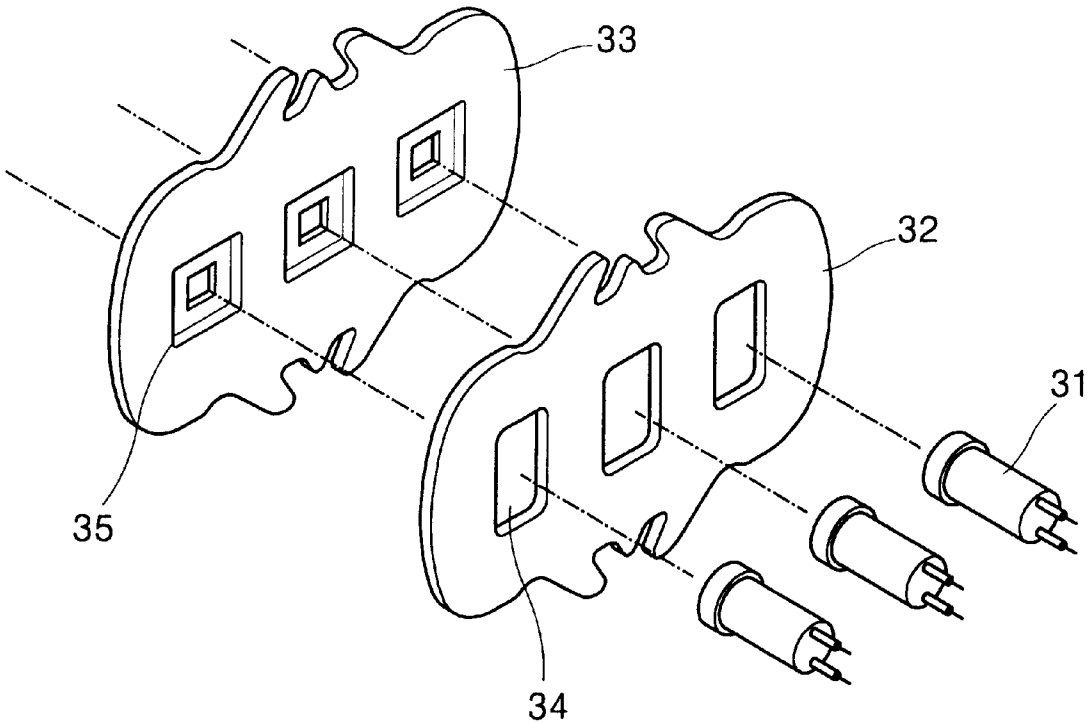
FIG. 3 is an exploded view of a second triode embodiment of the present invention.

FIG. 2 shows a triode of an electron gun according to an embodiment of the present invention. It consists of three cathodes 21, a control electrode 22 and a screen electrode 23 in sequence. The screen electrode 23 forms a pre-focus lens with a focus electrode disposed spaced apart therefrom. On the control electrode 22 and the screen electrode 23 are formed three in line electron-beam passing holes 24 and 25 corresponding to the three cathodes 21 such that electrons emitted from the cathodes 21 pass through the apertures. On the surface of the screen electrode 23 facing the control electrode 22 are formed a plurality of circular recesses 25. In the center of each of the recessed areas 25 is formed a circular hole for passing an electron beam. In other words, the entrance of the aperture 25*a* on the control electrode 22-facing surface is larger in diameter than the exit aperture 25*b* that can be seen from the opposite surface. The depth of the recess is preferably about one half of the electrode thickness. FIG. 3 shows a triode according to a second embodiment of the present invention. The second embodiment is the same as the first triode embodiment except that the recessed areas 35 each takes a rectangular shape, unlike the circular recesses 25 in the first embodiment.

Figure 4:
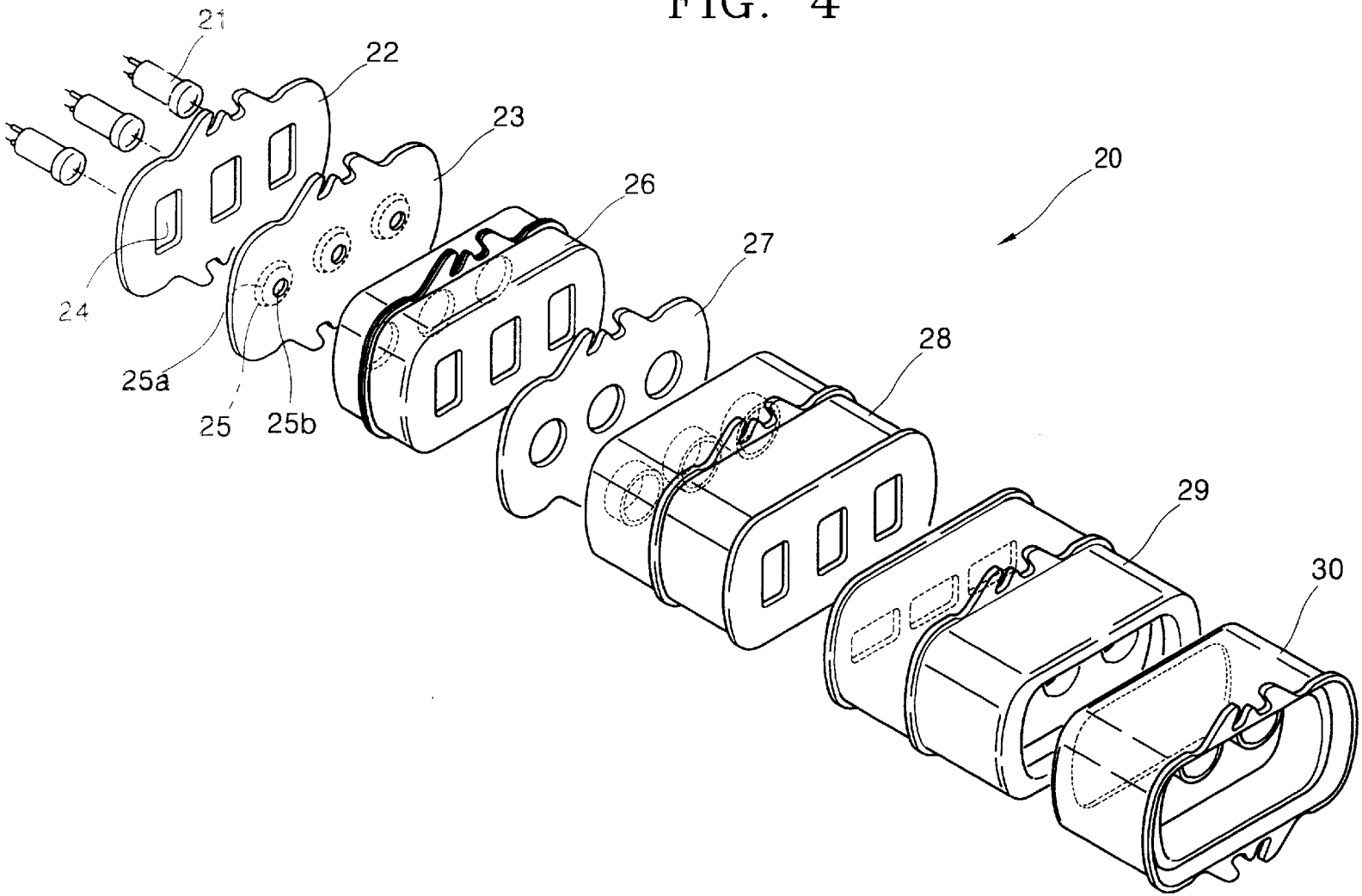
FIG. 4 is an electron gun employing the first triode embodiment of the present invention.

FIG. 4 shows an electron gun 20 where a triode embodiment according to the present invention is employed. Referring to the drawing, the operation and improvement of the present invention will be described. The electron gun 20 further comprises focus electrodes 26 through 29 and a final accelerating electrode 30, which forms a main lens along with the fourth focus electrode 29. All of the focus electrodes 26 through 29 and the final accelerating electrode 30 have three in-line electron beam passing holes. The sizes of the holes depend on a desired lens strength. A static focus voltage is applied to the third focus electrode 28 forming a quadrupole lens. To the fourth electrode 29 is applied a dynamic voltage synchronized with deflection signal. Also, an anode voltage higher than any other electrode signal voltages is applied to the final accelerating electrode 30. Once these voltages are applied to respective electrodes, a cathode lens is formed between the control electrode 22 and the screen electrode 23 and a pre-focus lens is formed between the screen electrode 23 and the first focus electrode 26. Because of the recessed area in the screen electrode 23, the electric field between the control electrode 22 and the screen electrode 23 penetrates into the apertures less than otherwise. It also allows the position of the cross-over point along the tube axis to be adjusted. This has an effect of smaller screen electrode apertures 25 with a result of increased pre-focusing of electron beams passing through the increased pre-focusing reduces the beam incident angle to the main lens. A smaller beam incident angle generates less spherical aberration in the main lens.

What is claimed is:

1. An electron gun for a cathode ray tube, said electron gun comprising:

cathodes for emitting electron beams in a propagation direction;

a control electrode being installed downstream of said cathodes and having a plurality of apertures for allowing the electron beams to pass through;

a screen electrode being installed downstream of said control electrode and having an entering face that faces said control electrode and an opposite exiting face, said screen electrode further having a plurality of cross-sectionally stepped apertures communicating the entering and exiting faces to allow the electron beams to pass through said screen electrode, each of said stepped apertures including first and second sections extending from the entering and exiting faces toward the exiting and entering faces, respectively, the first section being larger in size than the second section; and a plurality of focusing electrodes sequentially installed downstream of said screen electrode for focusing and accelerating the electron beams;

wherein the first and second sections are circular in shape.

2. An electron gun for a cathode ray tube, said electron gun comprising:

cathodes for emitting electron beams in a propagation direction;

a control electrode being installed downstream of said cathodes and having a plurality of apertures for allowing the electron beams to pass through;

a screen electrode being installed downstream of said control electrode and having an entering face that faces said control electrode and an opposite exiting face, said screen electrode further having a plurality of cross-sectionally stepped apertures communicating the entering and exiting faces to allow the electron beams to pass through said screen electrode, each of said stepped apertures including first and second sections extending from the entering and exiting faces toward the exiting and entering faces, respectively, the first section being larger in size than the second section; and a plurality of focusing electrodes sequentially installed downstream of said screen electrode for focusing and accelerating the electron beams;

wherein the first and second sections are rectangular in shape.

3. The electron gun of claim 1, wherein a diameter of the first section is larger than that of the second section.

4. The electron gun of claim 3, wherein the first and second circular sections are arranged concentrically.

5. An electron gun for a cathode ray tube, said electron gun comprising:

cathodes for emitting electron beams in a propagation direction;

a control electrode being installed downstream of said cathodes and having a plurality of apertures for allowing the electron beams to pass through;

a screen electrode being installed downstream of said control electrode and having an entering face that faces said control electrode and an opposite exiting face, said screen electrode further having a plurality of cross-sectionally stepped apertures communicating the entering and exiting faces to allow the electron beams to pass through said screen electrode, each of said stepped apertures including first and second sections extending from the entering and exiting faces toward the exiting and entering faces, respectively, the first section being larger in size than the second section; and a plurality of focusing electrodes sequentially installed downstream of said screen electrode for focusing and accelerating the electron beams;

wherein said electron gun comprises no electrodes between said cathodes and said control electrode, and between said screen electrode and said control electrode.

6. The electron gun of claim 3, comprising no electrodes between said cathodes and said control electrode, and between said screen electrode and said control electrode.

* * * * *